United States Patent [19]

Knickerbocker

[11] 4,436,360

[45] Mar. 13, 1984

[54] ELECTRICAL CONNECTORS AND TERMINAL CONNECTING BLOCK

[75] Inventor: Robert H. Knickerbocker, Cheshire, Conn.

[73] Assignee: The Siemon Company, Watertown, Conn.

[21] Appl. No.: 879,268

[22] Filed: Feb. 21, 1978

Related U.S. Application Data

[63] Continuation of Ser. No. 262,495, Jun. 14, 1972, Pat. No. 4,084,877, which is a continuation of Ser. No. 868,417, Oct. 22, 1969, abandoned.

[51] Int. Cl.[3] ..... H01R 9/08

[52] U.S. Cl. ..... 339/97 P

[58] Field of Search ..... 339/97 R, 97 P, 98, 339/99 R

[56] References Cited

U.S. PATENT DOCUMENTS 3,605,071 9/1971 Sedlacek ..... 339/97 P

*Primary Examiner*—Joseph H. McGlynn

*Attorney, Agent, or Firm*—David S. Fishman

[57] ABSTRACT

There is disclosed an electrical connector which comprises three adjacent fingers extending from a base. When an insulated electrical conductor is inserted between a pair of fingers, the insulation is crushed or cut making the desired contact. There is also disclosed a block of insulating material containing such connectors.

4 Claims, 10 Drawing Figures

ELECTRICAL CONNECTORS AND TERMINAL CONNECTING BLOCK

This application is a continuation of application Ser. No. 262,495 filed June 14, 1972, now U.S. Pat. No. 4,084,877 which was a continuation of application Ser. No. 868,417 filed Oct. 22, 1969, now abandoned.

This invention relates to electrical connectors, particularly to connectors which will crush or cut the insulation on a wire upon insertion therein. This invention further relates to an insulating block containing such connectors.

Terminal connecting blocks are used extensively in the fields of electronics and communications. For example, they are used by the telephone industry in distribution cabinets for connecting conductors in a cable from an exchange to other conductors extending to various stations within a building. Such connecting blocks should be as compact as possible so as to take up a minimum amount of space while providing means for making a large number of connections. The blocks should also be constructed to allow ready connection of new subscribers and the disconnection of those whose service is terminated.

It is an object of this invention to provide an electrical connector which automatically removes the insulation from a conductor, either by a cutting or crushing action, and makes the required contact.

It is another object of this invention to provide a miniaturized terminal connector which will indefinitely maintain good electrical contact with a conductor.

It is a further object of this invention to provide an insulating block containing such connectors securely engaged therein, which terminal connecting block is more compact than other blocks designed to accommodate an equivalent number of conductors.

These and other objects are attained by the practice of this invention which, briefly, comprises providing an electrical connector in the form of an integral spring metal piece comprising a flat base portion and three contact fingers projecting from the base portion. These fingers lie at least substantially in the same plane as the base portion. The fingers include a symmetrical central finger and two outer fingers, disposed each on a different side of the central finger.

The central finger has a stem portion, a contact body portion and a tip portion, the stem portion commencing at the flat base portion and projecting therefrom and the contact body portion commencing at the stem portion and projecting outwardly to the tip portion. The stem portion of the central finger is narrower than the contact body portion.

Each of the outer fingers also has a stem portion, a contact body portion and a tip portion. The stem portions and the contact body portions of the outer fingers are disposed, respectively, beside and are of substantially the same length as the stem and contact body portions of the central finger.

The side edges of the contact body portion of the central finger extend in substantial edge-to-edge contact with the adjacent side edge of each of the contact body portions of the outer fingers when the integral spring metal piece is in its normal, undistorted condition. The side edges of the stem portion of the central finger are spaced apart from the adjacent side edge of each of the stem portions of the outer fingers whereby the adjacent side edges of the stem portions cooperate to define elongated spaces between the stem portion.

Insertion of an electrical conductor between the contact body portion of one of the outer fingers and the contact body portion of the central finger causes the said outer finger and central finger to be resiliently distorted away from each other. This distortion of the central finger is opposed by the other of said outer fingers by reason of the interengagement between the contact body portions of the central finger and said other outer finger. This results in the reinforcement of the connector and in a more secure connection. This advantage is retained when a conductor is wedged between the contact body portions of each of the outer fingers and the central finger—i.e., the resilience of the two outer fingers tends to force them both toward the middle finger which results in securer connections.

The connectors of this invention are smaller and more compact than ones normally used and consequently of less volume. Therefore, they have less electrical resistance. Moreover, more connections may be made for a block of a given size, thus resulting in a savings on space and material used to make the block.

The invention will be more particularly described with reference to the accompanying drawings wherein.

Figure 1:
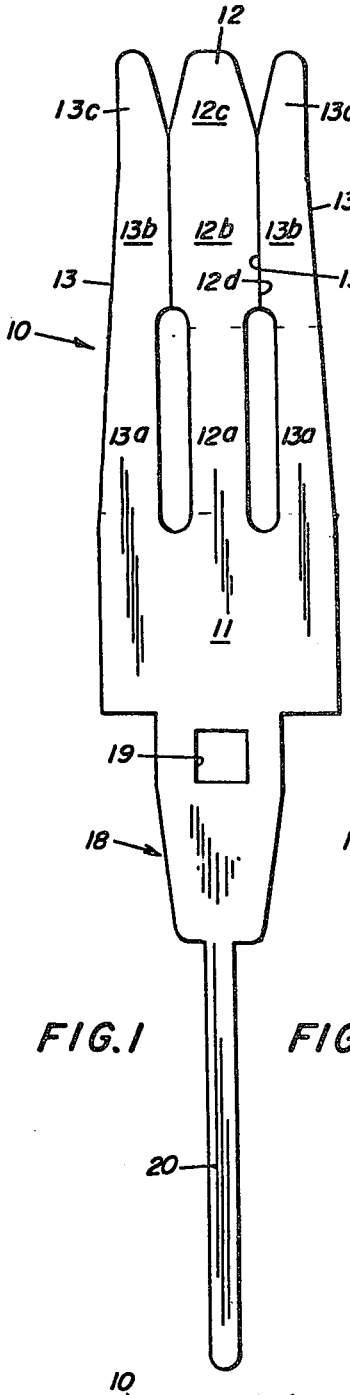
FIG. 1 is a front elevational view of an embodiment of a connector constructed according to this invention.
Figure 2:
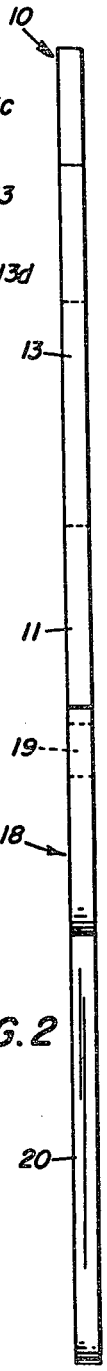
FIG. 2 is a side elevational view of the connector shown in FIG. 1.

Referring more particularly to the drawings, there is shown an electrical connector 10 in the form of an integral spring metal piece. The connector 10 may be constructed of any suitable resilient conducting material such as phosphor-bronze, beryllium-copper, or other known metal alloy. The metal may be plated with tin to prevent corrosion of the connector. The connector may be formed by known metal stamping methods.

The connector is comprised of a flat base portion 11, and three contact fingers projecting from the base portion. The fingers include a symmetrical central finger 12 and two outer fingers 13. The central finger has a stem portion **12*a*, a contact body portion 12*b*, and a tip portion 12*c*. The outer fingers likewise have stem portions 13*a*, contact body portions 13*b*, and tip portions 13*c* which are disposed adjacent to and of substantially the same length as the corresponding portions on the central finger 12**.

When the spring metal piece is in its normal, undistorted condition, i.e, when it does not have an electrical connector inserted therein, the adjacent side edges of the contact body portions **12*b* and 13*b* are in substantial edge-to-edge contact and, in any event, are spaced apart a distance less than the diameter of the electrical conductor which is to be inserted therein. The side edges of the stem portions 12***a* and 13*a* are spaced apart whereby they define an elongated space between the stem portions 12*a* and 13*a*. The tip portion 12*c* of the central finger is tapered on each side. The adjacent edges of the tip portions 13*c* diverge outwardly from the respective edges of the tip portion 12*c*, thereby defining a V-shaped, tapered mouth which facilitates the introduction of an electrical conductor.

In the embodiments shown in FIGS. 1 to 5, the adjacent side edge 12*d* and 13*d* of the contact body portion 12*b* and 13*b* are substantially flat. When an insulated electrical conductor 14 is forced down between the contact body portions 12*b* and 13*b*, the electrical insulation 15 on the wire 16 is crushed and abraded away so as to cause contact between the electrical connector 10 and the electrical conductor wire 16. The two outer fingers coact with the central finger to provide a better connection than would be obtained with only two fingers and one which is more resistant to weakening due to metal fatigue after long periods of use.

Figure 6:
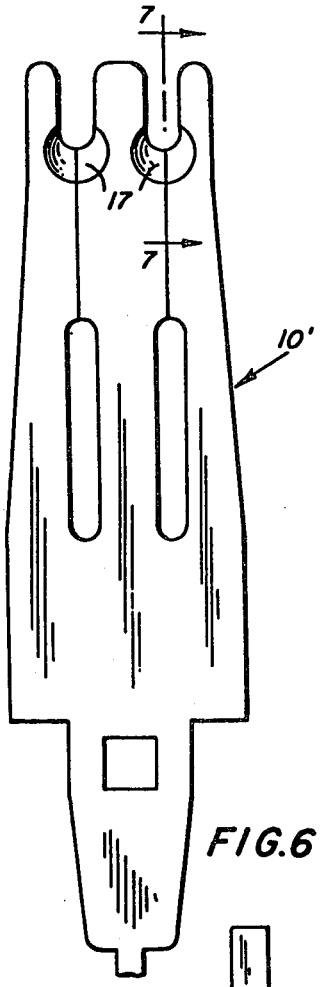
FIG. 6 is a fragmented front elevational view of a modified form of the connector shown in FIG. 1.
Figure 7:
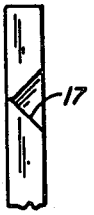
FIG. 7 is a view taken along line 7—7 in FIG. 6.
Figure 3:
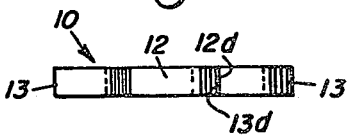
FIG. 3 is a plan view of the connector shown in FIG. 1.
Figure 5:
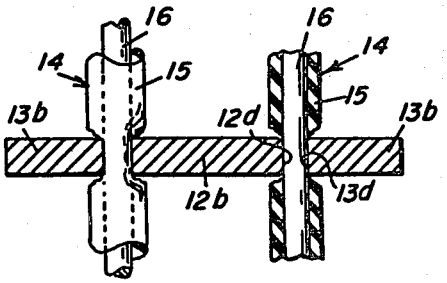
FIG. 5 is a sectional view taken along line 5—5 of FIG. 4.

According to another embodiment of this invention as shown in FIGS. 6 and 7, the connector may be provided with a beveled cutting portion 17 at the top of the contact edges between the central finger and the outer fingers. The cutting portion 17 is cone-shaped and the walls taper from the front face to the back face of the connector. At the back face of the connector, the adjacent edges of the central finger and the outer fingers define sharp edges which cut the insulation from an insulated electrical conductor when the conductor is forced therebetween. In this embodiment, the tip portions of the outer fingers and central finger are substantially straight rather than tapered as shown in the embodiment of FIG. 1.

Figure 4:
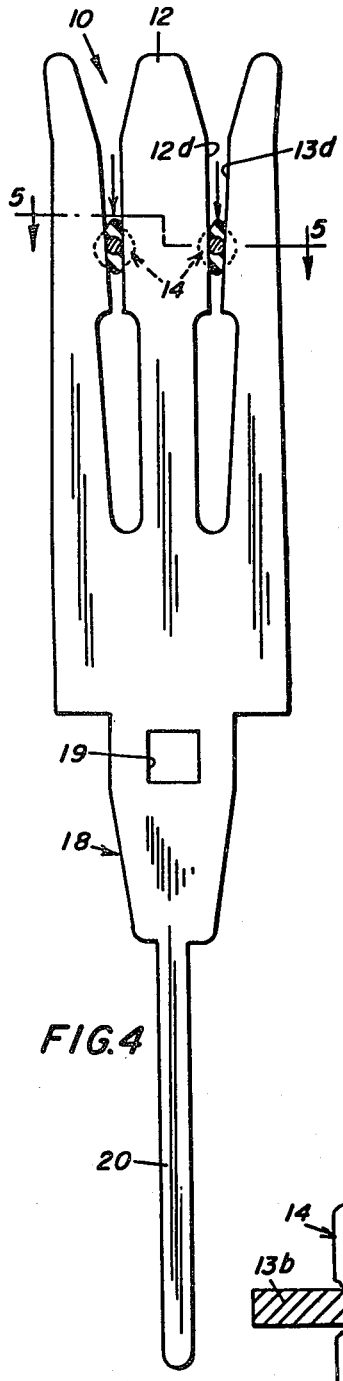
FIG. 4 is a front elevational view of the connector shown in FIG. 1 in combination with two insulated electrical conductors.

As shown in FIGS. 1 and 4, the electrical connector may have means for securing the connector into a terminal block integral with the base portion 11. The means illustrated comprises a shoulder portion 18 which contains an opening 19. An elongated, narrow portion 20 extends perpendicular to the body of the shoulder 18. The portion 20 is adapted to receive and be connected with a coil type, electrical conductor.

Figure 8:
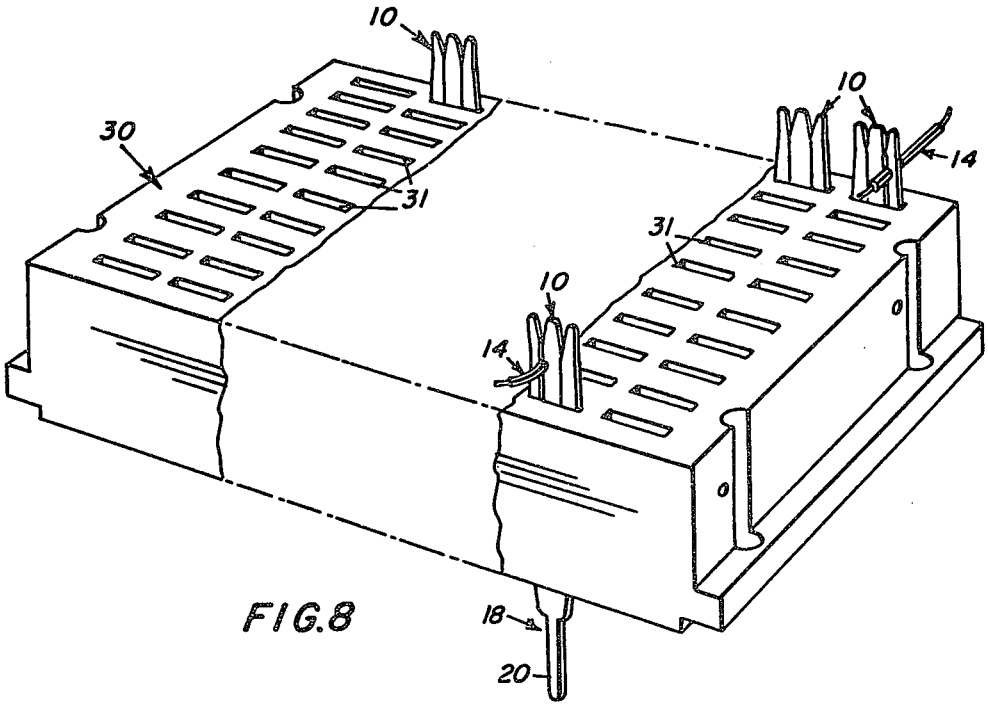
FIG. 8 is a perspective view of an insulating block containing electrical connectors of this invention.
Figure 9:
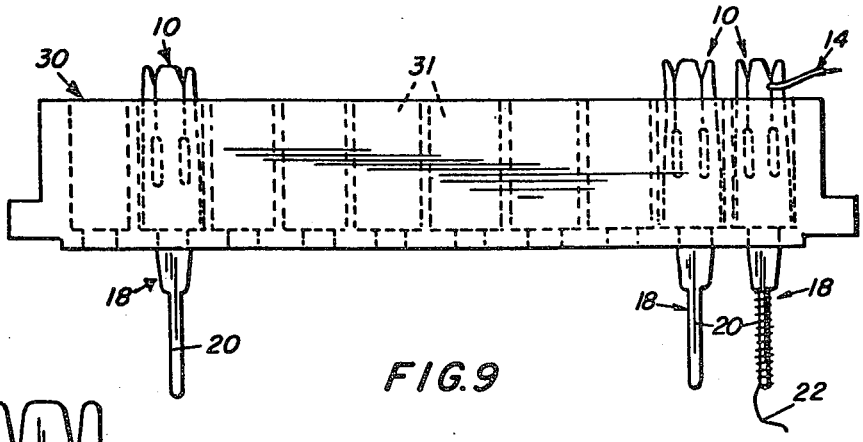
FIG. 9 is a front elevational view of a terminal connecting block.

As shown in FIGS. 8 and 9, a large number of the electrical connectors of this invention may be inserted in a block 30. The block 30 may be formed of a suitable electrical insulating material such as a phenol-formaldehyde resin or a polyvinyl resin. The block 30 contains a number of slots 31 extending through the block which are adapted to receive the connectors of this invention. These slots are arranged in a geometrical pattern designed to accomodate a maximum number of connectors in a minimum amount of space.

Since the connectors of this invention are flat, they may be easily inserted into the slots 31 in the block 30 and secured therein as hereinafter described. The tip portions 12*c* and 13*c* and a part of the contact body portions 12*b* and 13*b* extend above the surface of the block 30. The shoulders 18 and the elongated, narrow portions 20 extend below the surface of the block. By attaching a so-called "pigtail wire" conductor 22 to the elongated, narrow portion 21 and by inserting insulated electrical conductors 14 between the contact body portions 12*b* and 13*b* of the connectors 10, an almost infinite number of different types of connections may be made.

Figure 10:
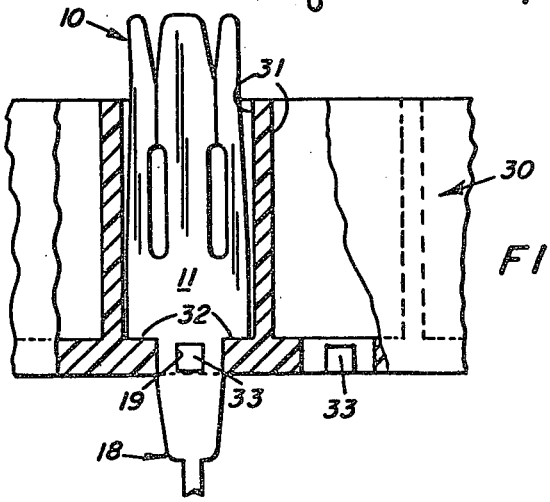
FIG. 10 is a fragmentary sectional view of a connecting block illustrating an electrical connector secured therein.

FIG. 10 illustrates the manner in which the electrical connectors of this invention are secured in the block. Each slot 31 is approximately as thick as the connectors 10 and, at the end through which the connectors are inserted, are of approximately the same width as the base portion 11 of the connectors. The other end of the slots have shoulders 32 on the edges thereof which serve to narrow the width of the slots to approximately the width of the top part of the shoulder 18 on the base portion 11. However, this space is narrower than the base portion 11. The narrower end of the slots 31 also contains small, resiliently deformable protuberances 33 on both sides thereof. When a connector is inserted into a slot 31, the protuberances 33 are depressed by the lower part of this shoulder 18 as it passes through the narrow end of the slot. After the lower part of the shoulder 18 has passed over the protuberances 33, they return to their original configuration and project into the opening 19. These protuberances and the abutting relationship of the base portion 11 with the shoulders 32 on the slots securely engage the connectors in the slots.

I claim:

1. A two-wire clip terminal comprising an elongate flat body formed from flat resilient metal and having two notches at its upper part, a base portion at its lower part, and a slot communicating with the lower end of each notch, said slots providing a center arm and two end arms extending in the same direction from a common base, the outer ends of said arms being free so as to provide three cantilever beams arranged side by side, the effective width of each end arm being less than the effective width of said center arm.

2. A two wire clip terminal as claimed in claim 1 which is rated for the diameter of the conductor portion of an insulated wire, and in which the bottom of each notch is rounded and has arcuate straight side edges which intersect the edges of said slot to provide substantially 90° sharp corner edges, the width of each said slot at said corner edges being no greater than said rated diameter.

3. A two wire clip terminal as claimed in claim 1 which includes an elongate aperture spaced below each notch, said slot extending between the bottom of each notch and the upper end of said aperture.

4. A two wire clip terminal as defined in claim 3 in which said elongate apertures define for said center arm, a section having a length substantially greater than said width so that the effective stiffness of said center arm is determined primarily by the width of said section.

* * * * *